United States Patent [19]

Mertin et al.

[11] Patent Number: 4,577,325

[45] Date of Patent: Mar. 18, 1986

[54] HYDRAULICALLY FORCING CONTACTS AGAINST ELECTRODES FOR ELECTROFURNACES

[75] Inventors: Theodor Mertin, Langenfeld; Franz S. Hagen, Dinslaken, both of Fed. Rep. of Germany

[73] Assignee: Mannesmann Aktiengesellschaft, Duesseldorf, Fed. Rep. of Germany

[21] Appl. No.: 668,037

[22] Filed: Nov. 5, 1984

[30] Foreign Application Priority Data

Nov. 4, 1983 [DE] Fed. Rep. of Germany ..... 3340390

[51] Int. Cl.[4] ..... H05B 7/10

[52] U.S. Cl. ..... 373/101

[58] Field of Search ..... 373/94, 99, 100, 101, 373/52, 103

[56] References Cited

U.S. PATENT DOCUMENTS 2,834,824 5/1958 Van Nostran ..... 373/100

4,154,974 5/1979 Wynne ..... 373/100

FOREIGN PATENT DOCUMENTS 626245 2/1936 Fed. Rep. of Germany ..... 373/101

2312099 9/1974 Fed. Rep. of Germany ..... 373/101

*Primary Examiner*—Roy N. Envall, Jr.

*Attorney, Agent, or Firm*—Ralf H. Siegemund

[57] ABSTRACT

The contact urging pressure force is provided through corrosion proof bellows interposed between two covers, one being affixed to a cooled electrode carrier ring, the other one being provided for obtaining the contact urging force; the interior of the bellows contains springs opposing the hydraulic force, and further containing a check valve whose holding element is affixed to the second mentioned cover, closing the opening of the first mentioned cover as long as the hydraulic pressure does not exceed a certain amount.

5 Claims, 1 Drawing Figure

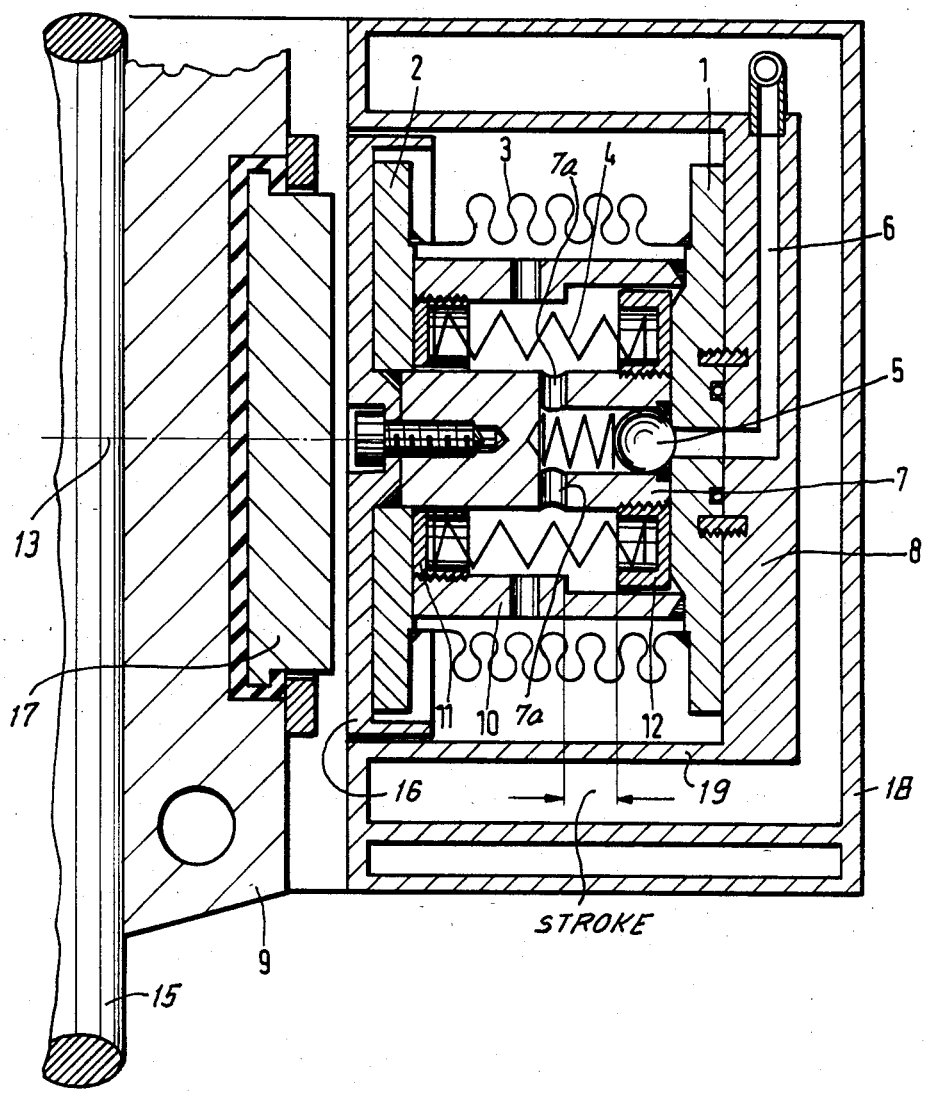
2
1
3
7a
4
6
5
7
8
13
17
11
10
7a
12
16
19
18
STROKE
9
15

HYDRAULICALLY FORCING CONTACTS AGAINST ELECTRODES FOR ELECTROFURNACES

BACKGROUND OF THE INVENTION

The present invention relates to a hydraulically operated pressure element for forcing contacts against electrodes in electrofurnaces and in a particular position under utilization of a cooled carrier ring circumscribing the respective electrodes, and being provided for carrying an extensible bushing.

Such a bushing is, for example, made of a cover fastened to the carrier ring, and another cover is disposed adjacent respective contacts with corrugated bellows interposed between the two covers; a hydraulic pressure medium forces the contact carrying cover under utilization of the extensibility of the bellows against the electrodes to ensure contact making.

Devices of the type referred to above are generally known. It was found, however, that the particular constructions used in the prior art are deficient in that a complete filling of the interior of the bellows through the hydraulic medium is not assured. Rather, air bubbles or an air cushion can remain which modifies the force relationships, and particularly the relationship between the pressure of the hydraulic medium as applied on one hand, and the force of contact making with the electrode on the other hand.

Such an air cushion can particularly arise during decompression and emptying of the interior cavity of the bellows as air may be sucked into the emptying space. Thus, the effective requirement for such a device to work with sufficient accuracy, namely, incompressibility or de facto incompressibility of the pressure medium, is no longer present. This of course may entail an interference with the function of the electrode clamping.

Another aspect to be considered is that the known bellows being used for the stated purpose are really of a relatively short life for reasons of inadequate resistance against corrosion due to the particular environment in which they have to operate which has, by necessity, certain chemically aggressive medium. To some extent related to this aspect, but from a different point of view quite independently therefrom, is another drawback of the known bellows, in that for reasons of manufacturing tolerances relatively large differences in the axial spring forces of the different bellows had been observed.

Another aspect to be considered is that the known bellows, and particularly in dependency upon their weight, i.e., of their mass involved, there is a certain reduction in wattless currents on account of modification in the induction of the electric current involved whenever the bellows expand or contract.

DESCRIPTION OF THE INVENTION

It is an object of the present invention to provide a new and improved structure for hydraulically forcing contact elements against electrodes in electric furnaces which avoid the deficiencies outlined above. I It is a particular object of the present invention to provide a new and improved hydraulic structure for permitting uniform urging of contact elements against the electrodes under conditions in which the pressure force is well defined, and under further utilization of an extendable bushing which has a considerably longer life than functionally comparable bushings of the prior art.

In accordance with the preferred embodiment of the present invention, it is suggested to provide a contact actuating device for urging a contact bracket against an electrode using an annular cooled ring as support, which arrangement includes a first cover affixed to said ring and having an opening through which hydraulic fluid can be applied, the device further including a second cover provided for force engagement with said contact bracket to urge that contact against the electrode, further including bellows preferably made of multiply, seamless configuration with at least one layer being made of a corrosion proof metal such as chromium nickel steel, and being connected to the aforementioned two covers, the interior of the bellows includes a plurality of springs opposing the hydraulic force inside of the bellows as a pressurized fluid is applied through the opening in the first mentioned cover. The latter cover is closed by means of a check valve in a holding element that is affixed to the second cover, the check valve can be lifted off when pressure exceeds a certain amount for unrestricted filling of the interior of the bellows with hydraulic fluid.

DESCRIPTION OF THE DRAWINGS

While the specification concludes with claims particularly pointing out and distinctly claiming the subject matter which is regarded as the invention, it is believed that the invention, the objects and features of the invention, and further objects, features and advantages thereof will be better understood from the following description taken in connection with the accompanying drawings in which:

The FIGURE shows a cross section through an inventive hydraulic operating element for contacts and electrodes in electrofurnaces, and being constructed in accordance with the preferred embodiment of the present invention for practicing the best mode thereof.

Proceeding now to the detailed description of the drawings, the FIGURE illustrates a contact bracket or element 9 provided for contact making with an electrode 15. The contact pressure is provided through a particular bushing cover 2 attached to an actuator 16 which in the illustrated condition has receded from contact actuator 17, the latter being connected to but electrically insulated from the contact 9.

The drawing furthermore illustrates an annular casing or ring 18 which contains a number of elements, whereby particularly an internal annular trough 19 has as a bottom a carrier ring 8. The interior of the annular casing 18 serves the conduction of a cooling medium to obtain cooling of the the casing and particularly of the carrier ring.

A first bushing cover 1 is affixed to the ring 8. The second cover 2 is interconnected to the first cover 1 through corrugated bellows 3. Depending upon pressure applied to the interior of the bellows, the cover 2 will be urged towards the contact actuator 17, or receded therefrom.

Inside bellows 3 are provided, annularly arranged, compression springs 4 tending to contract the bellows. These springs 4 bear with one end against a trough-like ring 11 being seated on cover 1 and circumscribing a sleeve 10, which in turn is connected (welded) to the cover 1. The ring 11 is permitted to slide in the sleeve 10. The respective other end of each of the springs 4 bears against an outer ring 12 around axis 13 and being of trough-like cross section and which circumscribes a holding element or sleeve 7 for a check valve. The check valve holder 7 is welded to cover 1 and actuator 16. The check valve includes a valve element 5 closing a duct in the cover 1, which communicates with a duct 6 in the ring 8. Pressure fluid is supplied through the duct 6 to the system, and under pressure of that fluid the valve element 5 recedes froms its valve seat. Ducts *7a* in holding element 7 permit fluid to flow into the interior of the bellows outside the element 7.

The casing 18 generally, and the ring 8 in particular, loop around the electrode 15, and the particular pressure elements are provided in the plurality; i.e., the arrangement 1, 2 and 3 with internal elements included and as illustrated, is one of a plurality which is arranged around the electrode 15. Thus, reference to an annular arrangement as far as element 8 and 18 is concerned, refers to an annular arrangement around the axis of electrode 15, while annular covers 1 and 2 in the bellows 3 loop around or are concentric with the axes 13.

It can thus be seen that the bellows 3 are relieved from providing the requisite spring force for the pressure element because the spring force is now established by the springs 4. This in fact is necessary because the bellows 3, or a layer thereof, are to be made of corrosion-proof material, preferably a chromium nickel steel. Choice of this material enhances the corrosion resistance of the bellows, but bellows made of chromium nickel steel (completely or in parts) have a very low axial spring force. Therefore, the requisite spring force of the system is provided by the springs 4. The check valve 5 has the advantage that in dependence upon the axial spring force primarily provided by the spring 4, but supplemented to some extent by the bellows 3, a certain definite positive internal pressure is maintained even after decompression of the resilient elements. This is critical for preventing the formation of any air bubble or any air cushion inside the cavities cirsumscribed by the bellows. The particular check valve permits, even for assembly of the systems, a filling with an incompressible medium. The internal pressure, i.e., the pressure force exerted against the contact, can fairly easily be adjusted through the check valve. This includes the possibility of relieving to some extent the pressure force. As the extension bushing, i.e., the bellows, fills, and as a certain pressure is reached, the valve element 5, together with the holding element 7, lifts off the cover 1 and can therefore no longer prevent filling of the interior of the valve. On the other hand, as long as a certain pressure is not exceeded, balance is maintained.

The invention is not limited to the embodiments described above, but all changes and modifications thereof not constituting departures from the spirit and scope of the invention are intended to be included.

We claim:

1. In an electrofurnace having an electrode, there being a cooled annular carrying ring provided for looping around the electrode, there being further at least one contact bracket for engagement with the electrode, a contact pressure producing device comprising:

a first bushing cover affixed to said carrier ring and having a central opening, there being pressure conduit means for providing hydraulic fluid to said opening;

a second bushing cover disposed for force engagement with said contacts;

bellows interposed between said first and second bushing covers and connected thereto;

resilient spring means interposed between said first and second bushing covers inside said bellows and providing a resilient force in opposition to any hydraulic force in the interior of the bellows tending to spread the two covers apart; and check valve means arranged in the interior of said bellows and mounted to a holding element affixed to said second cover for opening and closing said opening in said first cover, but being carried along whenever the pressure in the bellows exceeds a particular value.

2. In an arrangement as in claim 1, said bellows being of multiply configuration.

3. Arrangement as in claim 1, said bellows including at least one layer of a corrosion proof metal.

4. In an arrangement as in claim 3, said corrosion proof metal being chromium nickel steel.

5. In an arrangement as in claim 1 wherein said bellows are of seamless configuration.

* * * * *